US010839984B2

(12) United States Patent
Maioli et al.

(10) Patent No.: US 10,839,984 B2
(45) Date of Patent: Nov. 17, 2020

(54) METHOD AND ARMOURED CABLE FOR TRANSPORTING HIGH VOLTAGE ALTERNATE CURRENT

(71) Applicant: Prysmian S.p.A., Milan (IT)

(72) Inventors: Paolo Maioli, Milan (IT); Massimo Bechis, Milan (IT)

(73) Assignee: PRYSMIAN S.p.A., Milan (IT)

( * ) Notice: Subject to any disclaimer, the term of this patent is extended or adjusted under 35 U.S.C. 154(b) by 0 days.

(21) Appl. No.: 16/606,481

(22) PCT Filed: Apr. 21, 2017

(86) PCT No.: PCT/EP2017/059482

§ 371 (c)(1),
(2) Date: Oct. 18, 2019

(87) PCT Pub. No.: WO2018/192666

PCT Pub. Date: Oct. 25, 2018

(65) Prior Publication Data

US 2020/0090834 A1 Mar. 19, 2020

(51) Int. Cl.
*H01B 7/26* (2006.01)
*H01B 7/14* (2006.01)
(Continued)

(52) U.S. Cl.
CPC ..... *H01B 7/26* (2013.01); *H01B 7/14* (2013.01); *H01B 9/006* (2013.01); *H01B 9/025* (2013.01)

(58) Field of Classification Search
CPC . H01L 7/26; H01L 9/025; H01L 9/006; H01L 7/14; H01L 7/226; H01L 3/0271
(Continued)

(56) References Cited

U.S. PATENT DOCUMENTS 3,921,381 A * 11/1975 Vogelsberg ..... H01B 13/0271 57/294
4,584,432 A 4/1986 Thévenon
(Continued)

FOREIGN PATENT DOCUMENTS

DE 1918121 A1 10/1970
GB 1 159 428 A 7/1969
(Continued)

OTHER PUBLICATIONS

International Search Report form the European Patent Office in corresponding International Application No. PCT/EP2017/059482, dated Jan. 19, 2018.
(Continued)

*Primary Examiner* — Sherman Ng
(74) *Attorney, Agent, or Firm* — Finnegan, Henderson, Farabow, Garrett & Dunner, L.L.P.

(57) ABSTRACT

Armoured cable (10) comprising: —a plurality of cores (12) stranded together according to a core stranding direction; —an armour (16) surrounding the plurality of cores (12) and comprising a layer of metal wires (16*a*) helically wound around the cores (12) according to an armour winding direction; wherein the at least one of core stranding direction (21) and the armour winding direction (22) is recurrently reversed along the cable length L so that the armoured cable (10) comprises unilay sections (102) along the cable length where the core stranding direction (21) and the armour winding direction (22) are the same. The invention also relates to a method for improving the performances of the armoured cable (10) and to a method for manufacturing the armoured cable (10).

17 Claims, 4 Drawing Sheets

(51) Int. Cl.
*H01B 9/00* (2006.01)
*H01B 9/02* (2006.01)

(58) Field of Classification Search
USPC ..... 174/103
See application file for complete search history.

(56) References Cited

U.S. PATENT DOCUMENTS 4,803,309 A * 2/1989 Marin ..... H01B 9/025 156/50
4,828,352 A * 5/1989 Kraft ..... G02B 6/4407 385/109
5,745,628 A * 4/1998 Benzel ..... G02B 6/4482 156/64
6,140,589 A * 10/2000 Blackmore ..... H01B 7/0009 174/128.1
6,853,780 B1 * 2/2005 Brandi ..... G02B 6/443 385/103
9,431,153 B2 8/2016 Maioli et al.
2002/0136511 A1 * 9/2002 Cecchi ..... G02B 6/441 385/109
2003/0044137 A1 * 3/2003 Lopez ..... G02B 6/4494 385/113
2015/0170795 A1 * 6/2015 Maioli ..... H01B 7/26 174/108

FOREIGN PATENT DOCUMENTS

WO WO 2013/174455 A1 11/2013
WO WO 2016/034243 A1 3/2016

OTHER PUBLICATIONS

Written Opinion of the International Searching Authority from the European Patent Office in corresponding International Application No. PCT/EP2017/059482, dated Jan. 19, 2018.
The International Standard (IEC) 60287-1-1, "Electric cables—Calculation of the current rating", Second Edition, 2006, (71 pages).

* cited by examiner

METHOD AND ARMOURED CABLE FOR TRANSPORTING HIGH VOLTAGE ALTERNATE CURRENT

The present invention relates to an armoured cable for transporting alternate current. The invention also relates to a method for improving the performances of an armoured cable and to a method for manufacturing said armoured cable.

An armoured cable is generally employed in application where mechanical stresses are envisaged. In an armoured cable, the cable core or cores (typically three stranded cores in the latter case) are surrounded by at least one armour layer in the form of metal wires, configured to strengthen the cable structure while maintaining a suitable flexibility. Each cable core comprises an electric conductor in the form of a rod or of stranded wires, and an insulating system (comprising an inner semiconductive layer, an insulating layer and an outer semiconductive layer), which can be individually screened by a metal screen. The metal screen can be made, for example, of lead, generally in form of an extruded layer, or of copper, in form of a longitudinally wrapped foil or of braided wires.

When alternate current (AC) is transported into a cable, the temperature of the electric conductors within the cable cores rises due to resistive losses, a phenomenon referred to as Joule effect.

The transported current and the electric conductors are typically sized in order to guarantee that the maximum temperature in electric conductors is maintained below a prefixed threshold (e.g., below 90° C.) that guarantees the integrity of the cable.

The international standard IEC 60287-1-1 (second edition 2006-12) provides methods for calculating permissible current rating of cables from details of permissible temperature rise, conductor resistance, losses and thermal resistivities. In particular, the calculation of the current rating in electric cables is applicable to the conditions of the steady-state operation at all alternating voltages. The term "steady state" is intended to mean a continuous constant current (100% load factor) just sufficient to produce asymptotically the maximum conductor temperature, the surrounding ambient conditions being assumed constant. Formulae for the calculation of losses are also given.

In IEC 60287-1-1, the permissible current rating of an AC cable is derived from the expression for the permissible conductor temperature rise $\Delta\theta$ above ambient temperature $\theta_a$, wherein $\Delta\theta=\theta-\theta_a$, $\theta$ being the conductor temperature when a current I is flowing into the conductor and $\theta_a$ being the temperature of the surrounding medium under normal conditions, at a situation in which cables are installed, or are to be installed, including the effect of any local source of heat, but not the increase of temperature in the immediate neighbourhood of the cables to heat arising therefrom. For example, the conductor temperature $\theta$ should be kept lower than about 90° C.

For example, according to IEC 60287-1-1, in case of buried AC cables where drying out of the soil does not occur or AC cables in air, the permissible current rating can be derived from the expression for the temperature rise above ambient temperature:

$$I = \left[\frac{\Delta\theta - W_d \cdot [0.5 \cdot T_1 + n \cdot (T_2 + T_3 + T_4)]}{R \cdot T_1 + n \cdot R \cdot (1 + \lambda_1) \cdot T_2 + n \cdot R \cdot (1 + \lambda_1 + \lambda_2) \cdot (T_3 + T_4)}\right]^{-0.5} \quad (1)$$

where:

I is the current flowing in one conductor (Ampere)

$\Delta\theta$ is the conductor temperature rise above the ambient temperature (Kelvin)

R is the alternating current resistance per unit length of the conductor at maximum operating temperature (Ω/m);

$W_d$ is the dielectric loss per unit length for the insulation surrounding the conductor (W/m);

$T_1$ is the thermal resistance per unit length between one conductor and the sheath (K·m/W);

$T_2$ is the thermal resistance per unit length of the bedding between sheath and armour (K·m/W);

$T_3$ is the thermal resistance per unit length of the external serving of the cable (K·m/W);

$T_4$ is the thermal resistance per unit length between the cable surface and the surrounding medium (K·m/W);

n is the number of load-carrying conductors in the cable (conductors of equal size and carrying the same load);

$\lambda_1$ is the ratio of losses in the metal screen to total losses in all conductors in that cable;

$\lambda_2$ is the ratio of losses in the armouring to total losses in all conductors in the cable.

In case of three-core cables and steel wire armour, the ratio $\lambda_2$ is given, in IEC 60287-1-1, by the following formula:

$$\lambda_2 = 1.23\frac{R_A}{R}\left(\frac{2c}{d_A}\right)^2 \frac{1}{\left(\frac{2.77 R_A 10^6}{\omega}\right)^2 + 1} \quad (2)$$

where $R_A$ is the AC resistance of armour at maximum armour temperature (Ω/m);

R is the alternating current resistance per unit length of conductor at maximum operating temperature (Ω/m);

$d_A$ is the mean diameter of armour (mm);

c is the distance between the axis of a conductor and the cable centre (mm);

$\omega$ is the angular frequency of the current in the conductors.

The Applicant has observed that, in general, a reduction of losses in an armoured AC electric cable enables to increase the permissible current rating and, thus, to reduce the cross-section of the conductor(s) (thus, the cable size and the quantity of material necessary to make the cable) and/or to increase the amount of the current transported by the cable conductors (thus, the power carried by the cable).

The Applicant has investigated the losses in an armoured AC cable. In particular, the Applicant has investigated the losses in an armoured AC cable when part of the wires or all of the wires of the armour layer is made of ferromagnetic material, which is economically appealing with respect to a non-ferromagnetic material like, for example, austenitic stainless steel.

During its development activities, the Applicant has noted that losses are related to the magnetic field generated by AC current transported by the electric conductors, which causes eddy currents in the layers surrounding the cores (like, for example, the metal screen and the wires of the armour) and magnetic hysteresis of the ferromagnetic wires of the armour.

WO2013/174455 discloses a power cable comprising at least two cores stranded together according to a core stranding pitch A, and an armour comprising one layer of metal wires wound around the cores according to a helical armour winding lay and an armour winding pitch B. This document discloses that the armour losses can be reduced when the armour winding pitch B is unilay to the core stranding pitch A compared with the situation wherein the armour winding pitch B is instead contralay to the core stranding pitch A, and when the armour winding pitch B has a predetermined value with respect to the core stranding pitch A.

The Applicant has noted that, even if advantageous in terms of losses reduction with respect to a contralay cable configuration, the unilay cable configuration disclosed by WO2013/174455 can cause drawbacks in terms of mechanical performances of the cable, in particular, in terms of torsional stability of the cable during cable-laying.

As for submarine cable, while the deposition in shallow water (i.e. down to about 100 m) of a cable having an armour winding pitch B unilay to the core stranding pitch A does not cause substantial problem, on the contrary it can be advantageous (see for example GB 360 996), the deposition of a cable having an armour winding pitch B unilay to the core stranding pitch A in deep water (i.e. down to more than 100 m) or extra-deep water (i.e. down to more than 1000 m) can cause stress and damage to the cable cores. In fact, the deposition tensile strain tends to straighten the lay of the cable cores and of the armour wires; when the tensile load is high, due to deposition in deep and extra-deep water, and the armour winding pitch B is unilay to the core stranding pitch A, the drop of pulling force (for example, when the cable reaches the seabed) is likely to cause the cable to twist and buckle resulting in potential harms.

In case of deposition in deep or extra-deep water, a cable having an armour winding pitch B contralay to the core stranding pitch A is recommended, though this cable suffers of substantially greater armour losses, besides being generally more difficult to be coiled, too.

The Applicant found that in an armoured cable as above discussed, recurrent reversions of the stranding direction of the cable cores and/or the winding direction of the armour wires along the cable length improve the cable mechanical performance (compared with a cable having a whole unilay configuration) and, at the same time, reduce hysteresis and eddy current losses in the cable (compared with a cable having a whole contralay configuration).

In a first aspect the present invention relates to an armoured cable having a cable length and comprising:

a plurality of cores stranded together according to a core stranding direction;

an armour surrounding the plurality of cores and comprising a layer of metal wires helically wound around the cores according to an armour winding direction;

wherein at least one of the core stranding direction and the armour winding direction is recurrently reversed along the cable length so that the armoured cable comprises unilay sections along the cable length where the core stranding direction and the armour winding direction are the same.

In a second aspect the present invention relates to a method for improving the performances of an armoured cable having a cable length and comprising a plurality of cores stranded together according to a core stranding direction, each core comprising an electric conductor having a cross section area X; and an armour surrounding the plurality of cores, the armour comprising a layer of metal wires helically wound around the cores according to an armour winding direction; the armoured cable having losses when an alternate current I is transported, said losses determining a maximum allowable working conductor temperature θ, the method comprising the steps of:

reducing the losses by building the armoured cable such that at least one of the core stranding direction and the armour winding direction is recurrently reversed along the cable length so that the armoured cable comprises unilay sections along the cable length where the core stranding direction and the armour winding direction are the same;

building the armoured cable with a reduced value of the cross section area X of each electric conductor, as determined by the value of the reduced losses, and/or rating the armoured cable at the maximum allowable working conductor temperature θ to transport said alternate current I with an increased value, as determined by the value of the reduced losses.

In a third aspect, the present invention relates to a method for manufacturing an armoured cable with a cable length L having losses when an alternate current I is transported, said losses determining a rating of the cable at maximum allowable conductor temperature θ, comprising the steps of:

stranding a plurality of cores together according to a core stranding direction, each core comprising an electric conductor having a cross section area X, surrounding the plurality of cores by helically winding an armour comprising a layer of metal wires around the plurality of cores according to an armour winding direction, wherein at least one of the core stranding direction and the armour winding direction is recurrently reversed along the cable length L so that the armoured cable comprises unilay sections along the cable length L where the core stranding direction and the armour winding direction are the same, and wherein the cross section area X of each electric conductor is reduced and/or the rating of the cable at the maximum allowable working conductor temperature θ is increased, compared to a cable wherein the core stranding direction and armour winding direction are contralay along the cable length L.

By reducing the cable losses and, in particular, armour and screen losses, the invention advantageously enables to improve the performances of the armoured cable in terms of increased transported alternate current and/or reduced electric conductor cross section area X with respect to that of a whole contralay cable wherein the core stranding direction and the armour winding direction are and remain different all along the cable length.

In the cable market, a cable is offered for sale or sold accompanied by indication relating to, inter alia, the amount of transported alternate current, the cross section area X of the electric conductor/s and the maximum allowable working conductor temperature. With respect to a cable with a contralay configuration along its whole length, an armoured cable according to the invention will have of a reduced cross section area of the electric conductor/s with substantially the same amount of transported alternate current and maximum allowable working conductor temperature, and/or an increased amount of transported alternate current with substantially the same cross section area of the electric conductor/s and maximum allowable working conductor temperature.

This enables to make a cable with increased current capacity and/or to reduce the size of the conductors with consequent reduction of cable size, weight and cost compared with a cable with whole contralay configuration.

At the same time, as stated above, an armoured cable according to the invention enables to guarantee improved mechanical performances with respect to a cable with a whole unilay configuration (wherein the core stranding direction and the armour winding direction are equal to each other and remain as such all along the cable length).

In the present description and claims, the term "recurrently reversed along the cable length" in relation to the core stranding direction and the armour winding direction is used to indicate that the direction is reversed along the cable length more than one time so to have at least three consecutive sections having stranding and/or winding direction opposite one another.

In the present description and claims, the term "regularly reversed along the cable length" in relation to the core stranding direction and the armour winding direction is used to indicate that the direction is reversed along the cable length in conformity with a predetermined rule.

In the present description and claims, the term "core" is used to indicate an electric conductor surrounded by at least one insulating layer and, optionally, at least one semiconducting layer. The core can further comprise a metal screen surrounding the conductor, the insulating layer and the semiconducting layer/s.

In the present description and claims, the terms "armour winding direction" and "armour winding pitch" are used to indicate the winding direction and the winding pitch of the armour metal wires provided in one layer. When the armour comprises more than one layer of metal wires, the term "armour winding direction" and "armour winding pitch" are used to indicate the winding direction and winding pitch of the armour metal wires provided in the innermost layer.

In the present description and claims, the term "unilay" is used to indicate that the stranding of the cores and the winding of the metal wires of an armour layer have a same direction (for example, both left-handed or both right-handed), with a same or different pitch in absolute value.

In the present description and claims, the term "contralay" is used to indicate that the stranding of the cores and the winding of the metal wires of an armour layer have an opposite direction (for example, one left-handed and the other one right-handed), with a same or different pitch in absolute value.

In the present description and claims, the term "crossing pitch C" is used to indicate the length of cable taken by the wires of the armour to make a single complete turn around the cable cores. The crossing pitch C is given by the following relationship:

$$C = \left| \frac{1}{\frac{1}{A} - \frac{1}{B}} \right|$$

wherein A is the core stranding pitch and B is the armour winding pitch. A is positive when the cores stranded together turn right (right screw or, in other words, are right-handed) and B is positive when the armour wires wound around the cable turn right (right screw or, in other words, right-handed). The value of C is always positive. When the values of A and B are very similar (both in modulus and sign) the value of C becomes very large.

In the present description and claims, the term "ferromagnetic" indicates a material having a substantial susceptibility to magnetization, the strength of which depends on that of the applied magnetizing field, and which may persist after removal of the applied field. For example, the term "ferromagnetic" indicates a material that, below a given temperature, has a relative magnetic permeability significantly greater than 1, preferably greater than 100.

In the present description, the term "non-ferromagnetic" indicates a material that below a given temperature has a relative magnetic permeability of about 1.

In the present description and claims, the term "maximum allowable working conductor temperature" is used to indicate the highest temperature a conductor is allowed to reach in operation in a steady state condition, in order to guarantee integrity of the cable. The temperature reached by the cable in operation substantially depends on the overall cable losses, including conductor losses due to the Joule effect and dissipative phenomena. The losses in the armour and in the metal screen are another significant component of the overall cable losses.

In the present description and claims, the term "permissible current rating" is used to indicate the maximum current that can be transported in an electric conductor in order to guarantee that the electric conductor temperature does not exceed the maximum allowable working conductor temperature in steady state condition. Steady state is reached when the rate of heat generation in the cable is equal to the rate of heat dissipation from the surface of the cable, according to laying conditions.

In the present description and claims, the term "section" indicates a portion of the cable length having a given core stranding direction and armour winding direction.

In the present description and claims, the term "cable length" is used to indicate the length of a cable between two ends.

In a preferred embodiment, the cable length where at least one of the core stranding direction and the armour winding direction is recurrently reversed is that between two fixed points, a fixed point being, for example, a cable joint, the touch-down point on the seabed or the anchoring point on a deployment vessel.

The present invention in at least one of the aforementioned aspects can have at least one of the following preferred characteristics.

In a preferred embodiment, at least one of the core stranding direction and the armour winding direction is recurrently reversed along the cable length so that unilay sections alternate along the cable length with contralay sections. In this way, in the unilay sections the core stranding direction and the armour winding direction are both left-handed or both right-handed, while in the contralay sections one is right-handed and the other one is left-handed.

Preferably, at least one of the core stranding direction and the armour winding direction is regularly reversed along the cable length.

In an embodiment, at least one of the contralay sections comprises two different contralay sub-sections wherein the plurality of cores are stranded together with different core stranding pitches; and/or wherein the metal wires are wound around the cores with different armour winding pitches.

In an embodiment, only one of the core stranding direction and the armour winding direction is recurrently, preferably regularly reversed along the cable length.

Preferably, the core stranding direction is recurrently, preferably regularly reversed along the cable length, the armour winding direction being unchanged.

In an alternative embodiment, both the core stranding direction and the armour winding direction are recurrently, preferably regularly reversed along the cable length.

In this alternative embodiment, preferably, unilay sections are obtained wherein the core stranding and the armour winding are in a first direction (e.g. left-handed), alternated with unilay sections wherein both the core stranding and the armour winding are in a second direction (e.g. right-handed). In this case, contralay sections can be present or absent.

The number of reversions of at least one of the core stranding direction and the armour winding direction depends upon the cable type and/or length.

Preferably, the unilay sections along the cable length involve, as a whole, at least 20% of the cable length, more preferably at least 30%, even more preferably at least 40%, even more preferably at least 45% of the cable length.

Preferably, the unilay sections along the cable length involve, as a whole, no more than 80% of the cable length, more preferably no more than 70%, even more preferably no more than 60%, even more preferably no more than 55%.

Preferably, the unilay sections along the cable length cover about 50% of the cable length.

Suitably, at least one of the core stranding direction and the armour winding direction is recurrently reversed along the cable length so that N is the number of consecutive turns of the core stranding and/or armour winding in a first direction (e.g. left-handed or S-lay) and M is the number of consecutive turns of the core stranding and/or armour winding in a second direction, reversed with respect to the first direction (right-handed or Z-lay, when the first direction is left-handed). In particular, N is the number of complete, consecutive turns in a unilay (or contralay) section of the plurality of cores and/or of the metal wires about the cable longitudinal axis, in the first direction. M is number of complete, consecutive turns in a unilay (or contralay) section of the plurality of cores and/or of the metal wires about the cable axis, in the second direction.

N and M can be integer or decimal numbers.

N can be the same or vary along the cable length. In this way, the number N of turns can be the same or can vary in the different sections of the cable length wherein at least one of the core stranding direction and the armour winding is equal to the first direction.

M can be the same or vary along the cable length. In this way, the number M of turns can be the same or can vary in different sections of the cable length wherein at least one of the core stranding direction and the armour winding is equal to the second direction.

The sum of N and M of two consecutive cable sections can be the same or vary with respect to other/s consecutive cable section/s along the cable length.

N can be equal to or different from M.

Preferably, $N \geq 1$, more preferably $N \geq 2.5$. Preferably, $N \leq 10$, more preferably $N \leq 5$, even more preferably $N \leq 4$.

Preferably, $M \geq 1$, more preferably $M \geq 2.5$. Preferably, $M \leq 10$, more preferably $M \leq 5$, even more preferably $M \leq 4$.

Suitably, the plurality of cores is stranded together according to a core stranding pitch A.

The core stranding pitch A, in modulus, can be the same or vary along the cable length.

Preferably, the core stranding pitch A, in modulus, is of from 1000 to 3000 mm. More preferably, the core stranding pitch A, in modulus, is of from 1500 to 2600 mm. Low values of A can be economically disadvantageous as higher conductor length is necessary for a given cable length. On the other side, high values of A can be disadvantageous in term of cable flexibility.

Suitably, the armour metal wires are wound around the cores according to an armour winding pitch B.

The armour winding pitch B, in modulus, can be the same or vary along the cable length.

Preferably, in the contralay sections, the armour winding pitch B is greater, in modulus, than the armour winding pitch B in the unilay sections. This advantageously enables to reduce losses in contralay sections.

Preferably, the armour winding pitch B, in modulus, is of from 1000 to 3000 mm. More preferably, the armour winding pitch B, in modulus, is of from 1500 to 2600 mm. Low values of B can be disadvantageous in terms of cable losses. On the other side, high values of B can be disadvantageous in terms of mechanical strength of the cable.

Preferably, the armour winding pitch B is higher than 0.4 A. Preferably, $B \geq 0.5$ A. More preferably, $B \geq 0.6$ A. Even more preferably, $B \geq 0.75$ A. Preferably, the armour winding pitch B is smaller than 2.5 A. More preferably, the armour winding pitch B is smaller than 2 A. Even more preferably, the armour winding pitch B is smaller than 1.8 A. Even more preferably, the armour winding pitch B is smaller than 1.5 A.

Preferably, the armour winding pitch B is different (in sign and/or absolute value) from the core stranding pitch A ($B \neq A$). Such a difference is at least equal to 10% of pitch A. Though seemingly favourable in term of armouring loss reduction, the configuration with $B=A$ (both in sign and absolute value) would be disadvantageous in terms of mechanical strength of the cable.

In the unilay sections, the crossing pitch C is preferably higher than the core stranding pitch A, in modulus. Preferably, $C \geq 2$ A, in modulus. More preferably, $C \geq 3$ A, in modulus. Even more preferably, $C \geq 5$ A, in modulus. Even more preferably, $C \geq 10$ A, in modulus. Suitably, C can be up to 12 A.

In the contralay sections, the crossing pitch C is preferably lower than the core stranding pitch A, in modulus. Preferably, $C \leq 2$ A, in modulus. More preferably, $C \leq 3$ A, in modulus. Even more preferably, $C \leq 5$ A, in modulus. Even more preferably, $C \leq 10$ A, in modulus.

The changing of the core stranding direction and/or of the armour winding direction causes a transition zone where the cores and/or the armour wires are parallel to the cable longitudinal axis. The transition zone/s can be from a half to one third of the core stranding pitch A and/or of the armour winding pitch B.

Preferably, each electric conductor is individually screened by a metal screen. More preferably, the metal screen is made of lead in form of an extruded layer.

Preferably, at least part of the armour metal wires is made of ferromagnetic material.

Preferably, part of the armour metal wires is made of non-ferromagnetic material.

In a preferred embodiment, part of the armour metal wires is made of ferromagnetic material and the rest of the armour metal wires is made of non-ferromagnetic material.

In an embodiment, part of the armour metal wires is made of a ferromagnetic core surrounded by a non-ferromagnetic material.

In an embodiment, part of the armour metal wires is made of a ferromagnetic core surrounded by an electrically conductive, non-ferromagnetic material.

In a preferred embodiment, in the armour layer, the metal wires made of ferromagnetic material alternate with the metal wires made of non-ferromagnetic material.

In an embodiment, all the armour metal wires are made of ferromagnetic material.

Preferably, the ferromagnetic material is selected from: construction steel, ferritic stainless steel, martensitic stainless steel and carbon steel, optionally galvanized.

Preferably, the non-ferromagnetic material is selected from: polymeric material and stainless steel.

Suitably, the plurality of cores is helically stranded together.

In an embodiment, the armour comprises a further layer of metal wires surrounding the layer of metal wires. The metal wires of the further layer are suitably wound around the cores according to a further layer winding direction and a further layer winding pitch B'. Preferably, the metal wires of the further layer are helicoidally wound around the cores.

Preferably, the further layer winding direction is opposite (contralay) with respect to the winding direction of the armour metal wires of the underlying layer.

This contralay configuration of the further layer is advantageous in terms of mechanical performances of the cable.

Preferably, the further layer winding pitch B' is lower, in absolute value, of the armour winding pitch B.

Preferably, the further layer winding pitch B' differs, in absolute value, from B by ±10% of B.

The armour metal wires can have polygonal or, preferably, circular cross-section. In alternative, the metal wires can have an elongated cross section. In the case of an elongated cross-section, the cross-section major axis is preferably oriented tangentially with respect to a circumference enclosing the plurality of cores.

Preferably, in case of circular cross-section, the metal wires have a cross-section diameter of from 2 to 10 mm. Preferably, the diameter is of from 4 mm. Preferably, the diameter is not higher than 7 mm.

Preferably, the plurality of cores are each a single phase core. Preferably, the plurality of cores is multi-phase cores (that is, they have phases different to each other).

In a preferred embodiment, the cable comprises three cores. The cable preferably is a three-phase cable. The three-phase cable preferably comprises three single phase cores.

The armoured cable can be a low, medium or high voltage cable (LV, MV, HV, respectively). The term low voltage is used to indicate voltages lower than 1 kV. The term medium voltage is used to indicate voltages of from 1 to 35 kV. The term high voltage is used to indicate voltages higher than 35 kV.

The armoured cable may be terrestrial. The terrestrial cable can be at least in part buried or positioned in tunnels.

Preferably, the armoured cable is a submarine cable.

The features and advantages of the present invention will be made apparent by the following detailed description of some exemplary embodiments thereof, provided merely by way of non-limiting examples, description that will be conducted by making reference to the attached drawings, wherein:

FIG. 1 schematically shows an armoured cable according to an embodiment of the invention;

FIG. 2 schematically shows an embodiment of the invention wherein the core stranding direction is regularly reversed along the cable length;

FIG. 3 schematically shows an embodiment of the invention wherein the armour winding direction is regularly reversed along the cable length;

Figure 1:
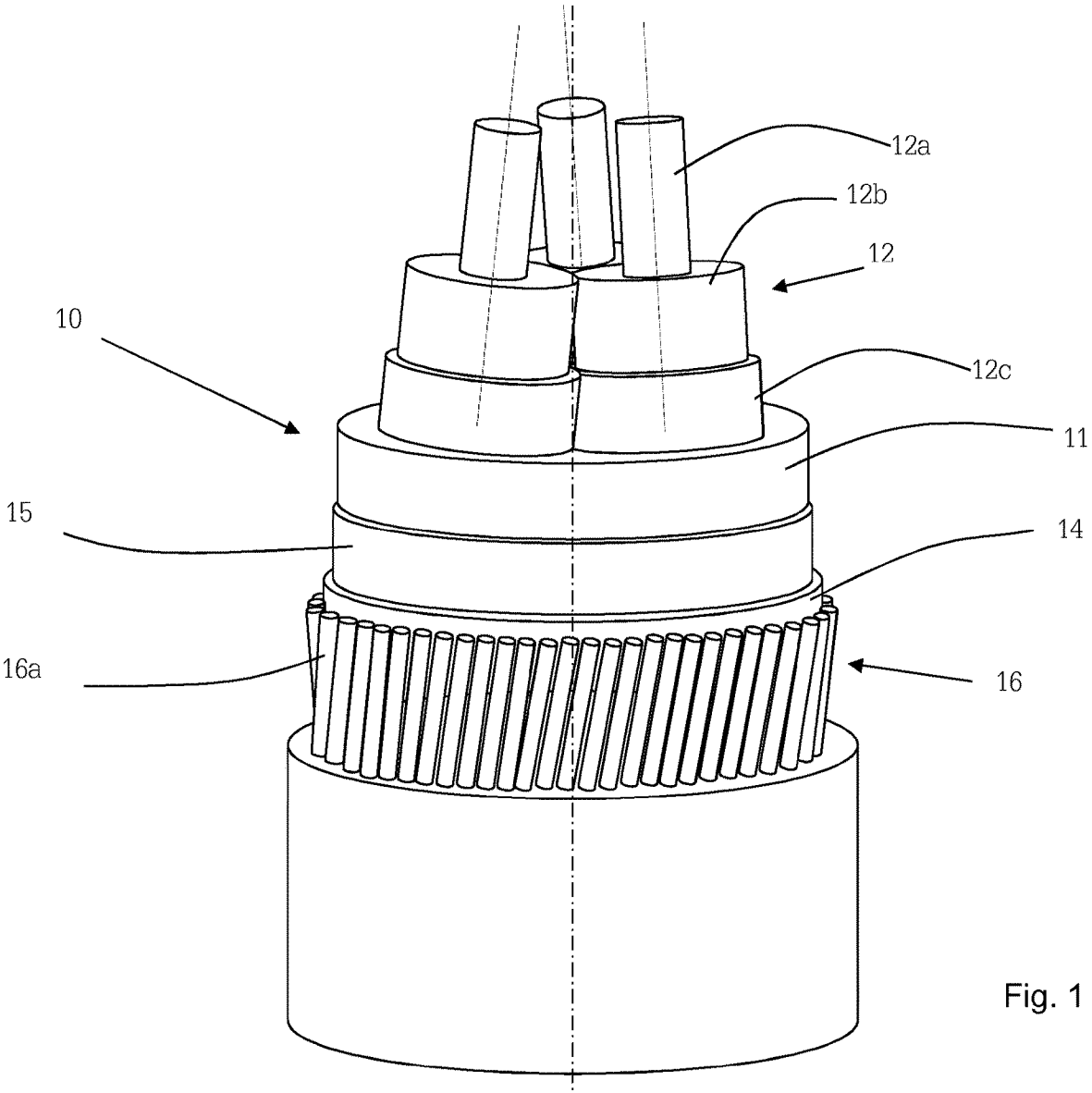

FIG. 1 schematically shows an AC cable 10 for submarine application comprising three-phase cores 12. Each core comprises a metal conductor 12*a* in form of a rod or of stranded wires. The metal conductor 12*a* can, for example, be made of copper, aluminium or both. Each metal conductor 12*a* is sequentially surrounded by an insulating system 12*b* made of an inner semiconducting layer, an insulating layer and an outer semiconducting layer, said three layers (not shown) being based on polymeric material (for example, polyethylene), wrapped paper or paper/polypropylene laminate. In the case of the semiconducting layer/s, the material thereof is charged with conductive filler such as carbon black. The three cores 12 further comprise each metal screen 12*c*. The metal screen 12*c* can be made of lead, generally in form of an extruded layer, or of copper, in form of a longitudinally wrapped foil or of braided wires.

The three cores 12 are helically stranded together according to a core stranding pitch A and a core stranding direction.

The three cores 12 are, as a whole, embedded in a polymeric filler 11 surrounded, in turn, by a tape 15 and by a cushioning layer 14. For example, the tape 15 is a polyester or non-woven tape, and the cushioning layer 14 is made of polypropylene yarns.

Around the cushioning layer 14, an armour 16 comprising a single layer of metal wires 16*a* is provided. The wires 16*a* are helically wound around the cable 10 according to an armour winding pitch B and an armour winding direction.

The armour 16 surrounds the three cores 12 together, as a whole.

At least part or all the metal wires 16*a* are made of a ferromagnetic material, which is advantageous in terms of costs with respect to non-ferromagnetic metals like, for example, stainless steel.

The ferromagnetic material can be, for example, carbon steel, construction steel or ferritic stainless steel, optionally galvanized.

The conductor 12*a* has a cross section area X, wherein $X=\pi(d/2)^2$, d being the diameter of the conductor 12*a*.

According to the invention, at least one of the core stranding direction and the armour winding direction is recurrently reversed along the cable length so that the cable 10 comprises unilay sections along the cable length wherein the core stranding direction and the armour winding direction are the same.

Figure 2:
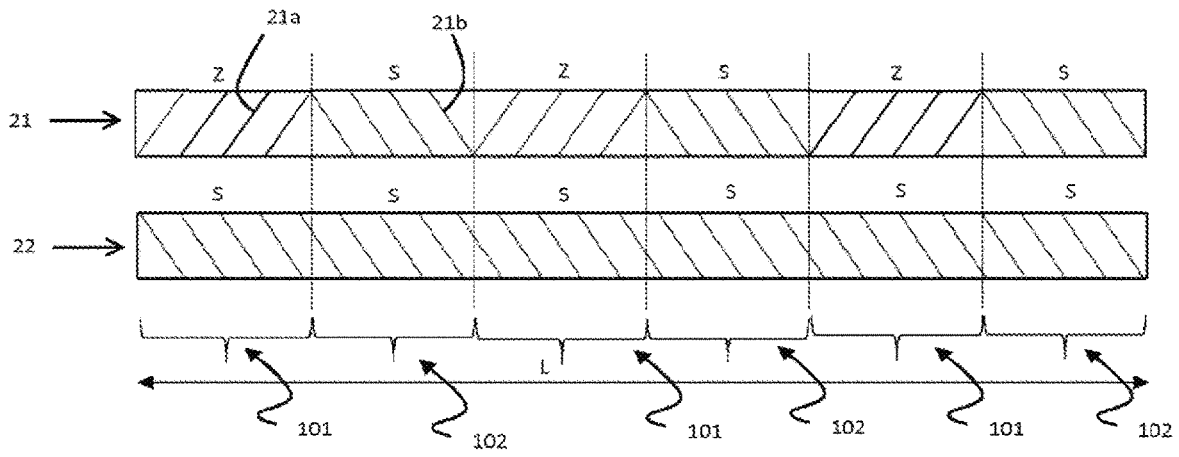

FIG. 2 schematically shows an embodiment wherein the core stranding direction 21 is regularly reversed along the cable length so that the cores are alternately stranded together according to a right-handed (or clockwise) direction Z (Z-lay) and a left-handed (or counterclockwise) direction S (S-lay). This alternated laying configuration is hereinafter called S/Z configuration. On the other side, the armour winding direction 22 is unchanged along the cable length. In particular, in the embodiment shown, the armour winding direction is left-handed S. In this way, the cable comprises unilay sections 102 along the cable length L wherein the core stranding direction and the armour winding direction are the same (in the embodiment shown, they are both S). The cable also comprises contralay sections 101 along the cable length L wherein the core stranding direction and the armour winding direction are the opposite. In particular, in the embodiment shown, the core stranding direction is Z while the armour winding direction is S.

Figure 3:
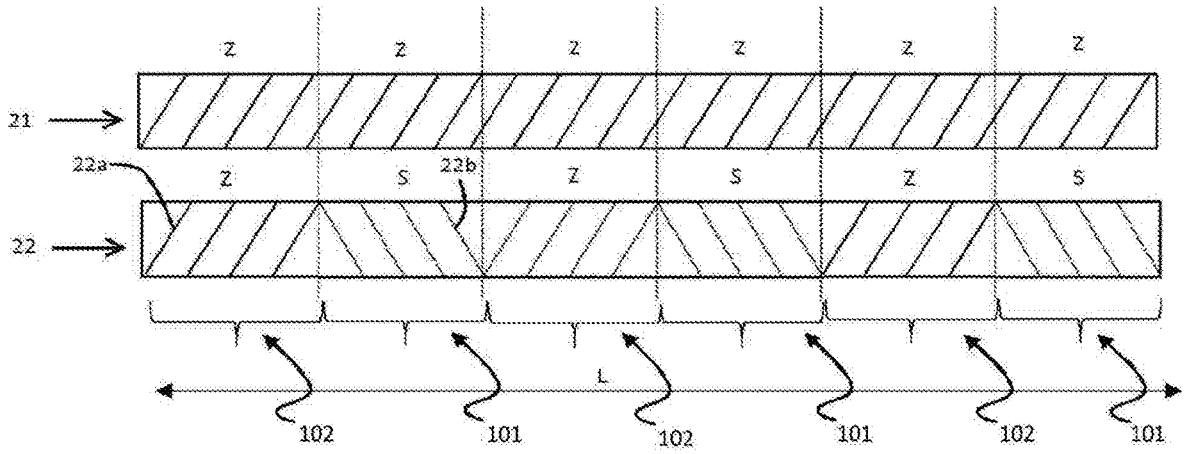

FIG. 3 schematically shows another embodiment wherein the armour winding direction 22 is regularly reversed along the cable length so that the armour metal wires are alternately stranded together according to a right-handed (or clockwise) direction Z and a left-handed (or counterclockwise) direction S. On the other side, the core stranding direction 21 is unchanged along the cable length L. In particular, in the embodiment shown, the core stranding direction is right-handed Z. In this way, the cable comprises unilay sections 102 along the cable length L wherein the core stranding direction and the armour winding direction are the same (that is, in the embodiment shown, they are both Z). The cable also comprises contralay sections 101 along the cable length L wherein the core stranding direction and the armour winding direction are the opposite. In particular, in the embodiment shown, the core stranding direction is Z while the armour winding direction is S.

FIG. 2 shows an embodiment wherein the number N of turns 21*a* of the cores in a Z section (a section of the cable length L with a Z core stranding direction) and the number M of turns 21*b* of the cores in a S section (a section of the cable length with a S core stranding direction) are equal to each other (in the example, N=M=4).

Analogously, FIG. 3 shows an embodiment wherein the number N of turns 22*a* of the armour metal wires in a Z section (a section of the cable length L with a Z armour winding direction) and the number M of turns 22*b* of the armour metal wires in a S section (a section of the cable length with a S armour winding direction) are equal to each other (in the example, N=M=4).

The case on N=M can be advantageous in terms of mechanical construction of the cable.

However, the invention also applies to the case wherein N is different from M.

Moreover, N and M can be either integer or decimal numbers. N and/or M can be the same (i.e. unchanged) along the cable length L (as shown in FIGS. 2 and 3) or vary (when N has different values in different S sections and M has different values in different Z sections).

N is preferably greater than 2.5 and lower than 4.

M is preferably greater than 2.5 and lower than 4.

FIGS. 2 and 3 schematically show examples wherein the core stranding pitch A and the armour winding pitch B are, in modulus, equal to each other and unchanged along the cable length. However, the core stranding pitch A and the armour winding pitch B are preferably different from each other (in sign and/or absolute value) in order to avoid drawbacks in terms of mechanical strength of the cable.

Moreover, the core stranding pitch A and/or the armour winding pitch B can vary along the cable length.

Figure 4:
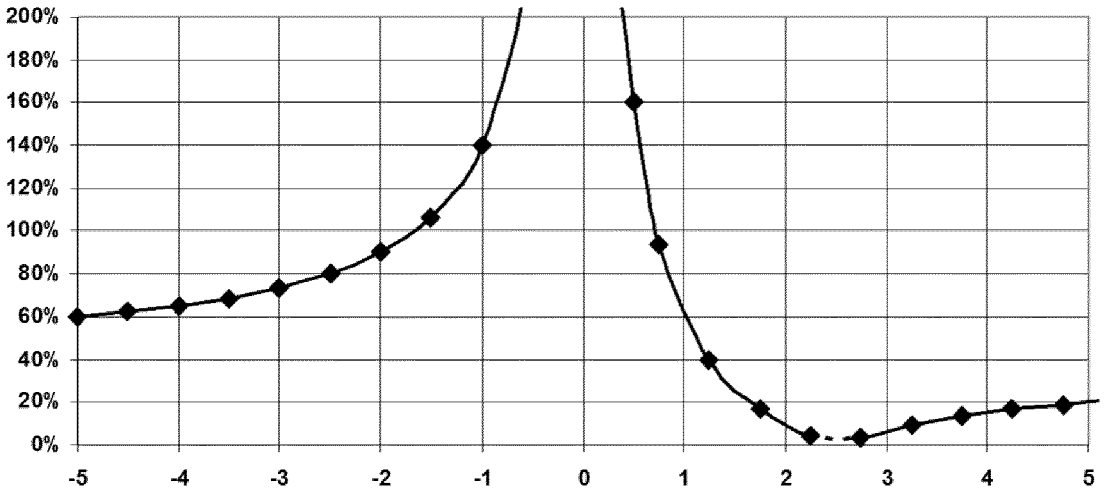
FIG. 4 shows the armour losses computed for a three-core cable versus the armour winding pitch B, by considering the armour losses inversely proportional to crossing pitch C.
Figure 5:
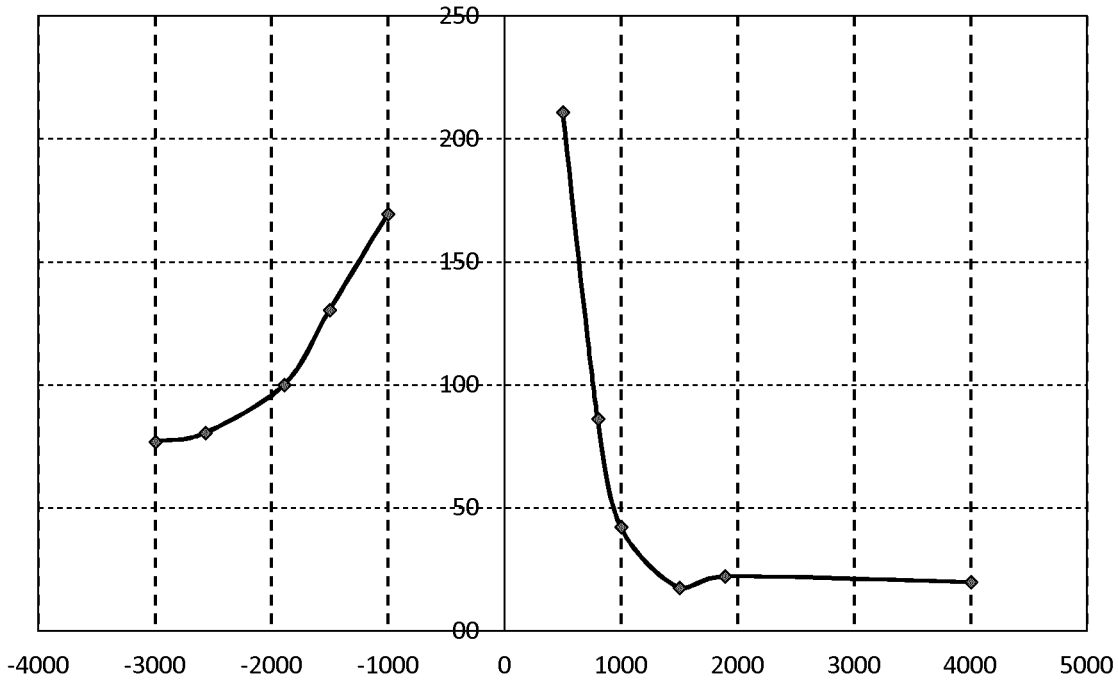
FIG. 5 shows the armour losses versus the armour winding pitch B computed for the same cable of FIG. 4 by using a 3D FEM computation.

For example, in an embodiment (not shown) of the invention, the armour winding pitch B in the contralay sections 101 is preferably greater, in modulus, than the armour winding pitch B in the unilay sections 102. As shown in FIGS. 4-5 described below, a higher value of B, in modulus, advantageously enables to limit the armour losses in the contralay sections 101 (the armour losses in the unilay sections 102 being already reduced by the unilay configuration per se).

Further details about the values of A and B are disclosed, for example, by U.S. Pat. No. 9,431,153, the disclosure of which is herein incorporated by reference.

With reference to what disclosed by U.S. Pat. No. 9,431,153, FIG. 4 shows the percentage of armour losses (in ordinate) versus the armour winding pitch B (in abscissa; meters), as obtained by computing by assuming the armour losses as inversely proportional to crossing pitch C. The following conditions were considered: an AC three-core cable with the cores stranded together according to a core stranding pitch A, with A=2500 mm; only one armour wire, wound around the cable according to a variable armour winding pitch B; a current of 800 A into the conductors; a conductor cross section area X of 800 $mm^2$. Negative value of the armour winding pitch B means contralay winding directions of the armouring wires with respect to the cores; positive value of the armour winding pitch B means unilay winding directions of the armouring wires with respect to the cores. The computation considered losses at 100% those empirically measured with a comparative contralay cable having three cores stranded together according to a core stranding pitch A of 2570 mm; an armour single layer of wires wound around the cable according to an armour winding pitch B contralay to the core stranding pitch A, B being −1890 mm, and crossing pitch C equal to about 1089 mm; a wire diameter d of 6 mm; a cross section area X of 800 $mm^2$.

With reference to the disclosure of U.S. Pat. No. 9,431,153, FIG. 5 shows the armour loss percentages (in ordinate) as a function of the armour winding pitch B (in abscissa, mm), as obtained by using a 3D FEM (Finite Element Method) computation, for verifying the hypothesis made in the computation of FIG. 4 Like in the case of the computation of FIG. 4, the FEM computation considered losses at 100% those empirically measured with the comparative contralay cable.

Both figures show that the armour losses are highly reduced when the armour winding pitch B is unilay to the core stranding pitch A, compared with the situation wherein the the armour winding pitch B is contralay to the core stranding pitch A. The armour losses have a minimum when core stranding pitch A and armour winding pitch B are equal (unilay cable with cores and armour wire with the same pitch) while they are very high when B is close to zero (positive or negative). In addition, an increase of armour winding pitch B—either unilay or contralay with respect to core stranding pitch A—brings to reduction of the armouring losses. In order to reduce losses, the armour winding pitch B is preferably higher than 0.4 A.

During development activities performed by the Applicant in order to investigate the losses (in particular, armour and metal screen losses) in an AC armoured cable, the Applicant analyzed an AC cable having: three cores stranded together according to a S/Z configuration (of the type shown in FIG. 2) with a core stranding pitch A of 3000 mm in absolute value (A being equal to +3000 mm in the Z sections and to −3000 mm in the S sections); a single layer of ninety-five (95) wires of galvanized ferritic steel wound around the cable according to a S armour winding direction and an armour winding pitch B of −2000 mm; a crossing pitch C equal to 1200 mm in the contralay sections; a crossing pitch C equal to 6000 mm in the unilay sections; an external wire diameter d of 7 mm; a cross section area X of 1000 $mm^2$ for a rated voltage of 150 KV; an overall external diameter of the cable of 246 mm; a metal screen of lead with an electrical resistivity of $21.4 \cdot 10^{-8}$ Ohm·m and relative magnetic permeability $\mu_r=1$; and armour wires with an electrical resistivity of $20.8 \cdot 10^{-8}$ Ohm·m and relative magnetic permeability $\mu_r=300$.

Results of the Applicant's activities are given in the examples 1-3 below.

EXAMPLE 1

A first sample of the cable has been cut in order to obtain a single contralay section of the cable (named S-Z sample), with S armour winding direction and Z core stranding direction.

A second sample (named S-Z/S sample) of the cable has been cut in order to obtain a first half of the sample in contralay condition (with a single contralay section having S armour winding direction and Z core stranding direction) and the remaining half of the sample in unilay condition (with a single unilay section having S armour winding direction and S core stranding direction).

A third sample of the cable has been cut in order to obtain a single unilay section of the cable (named S-S sample), with S armour winding direction and S core stranding direction.

All of the threes samples had the same length.

The three samples have been tested in order to experimentally measure a value of the ratio between the eddy currents in the metal screens ($I_{screen}$) and the current in the conductors ($I_{conductor}$). The following Table 1 shows the measured values.

TABLE 1

| Sample | $I_{screen}/I_{conductor}$ |
|---|---|
| S-Z sample | 0.219 |
| S-Z/S sample | 0.203 |
| S-S sample | 0.192 |

The experimental measures show that the S-Z/S sample enables to reduce the eddy currents in the metal screens and thus, the cable losses, with respect to a contralay configuration (S-Z sample).

The unilay configuration (S-S sample) has the best performances in terms of reduction of eddy currents in the metal screens and, thus, of screen losses. However, as said above, a whole unilay configuration is disadvantageous in terms of mechanical performances of the cable, especially in terms of torsional stability of the cable during laying operations.

On the other side, the contralay configuration (S-Z sample) has the worst performances in terms of reduction of eddy currents in the metal screens and, thus, of screen losses.

The configuration according to the invention, wherein contralay sections alternate with unilay sections, enables, on the one side, to reduce cable losses with respect to a whole contralay configuration and, on the other side, to improve the mechanical performances of the cable, especially during laying operations, with respect to a whole unilay configuration.

Figure 6:
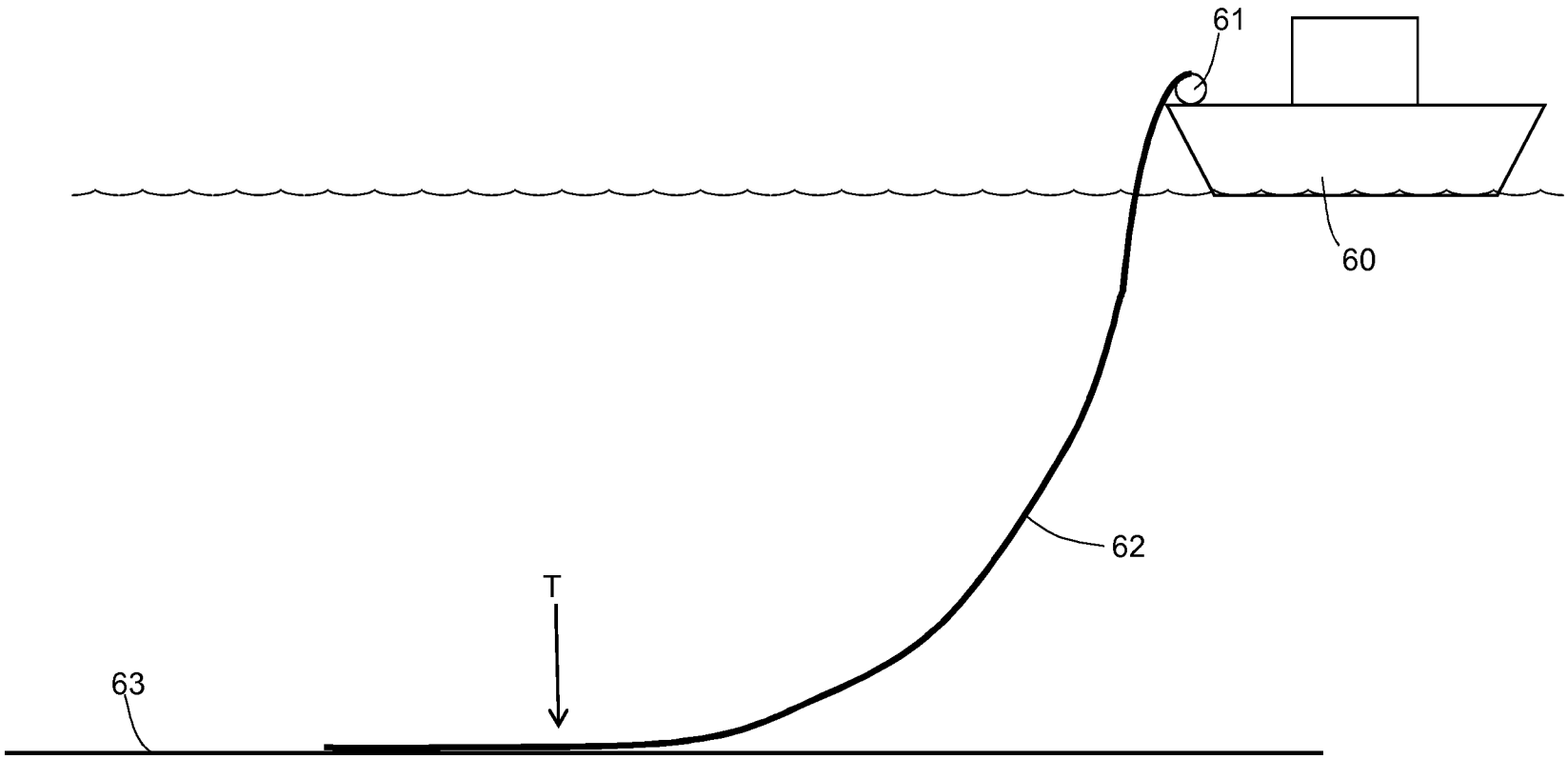
FIG. 6 is a sketch of a submarine cable deployment.

FIG. 6 sketches a laying operation of a submarine cable 62. The cable 62 is connected to an anchoring point 61 on a deposition vessel 60, and a tensile strain is exerted on the cable 62 between the anchoring point 61 and a point T where the cable 62 touches the seabed 63, the point T substantially corresponding to the deposition depth. During deployment, the tensile strain tends to straighten the lay of the cable cores and of the armour wires. In case of unilay configuration at least between anchoring point 61 and point T, and especially in deep or extra-deep water deployment, the drop of tensile strain on the cable, possibly occurring during laying operation or when the cable reaches the seabed (point T), could result in a cable buckling up to a bending radius which could compress the cores and result in potential harms. According to the configuration of the invention, this phenomenon is counterbalanced by contralay sections so that the torsional stability of the cable as a whole is not affected.

Similar results can be obtained in an embodiment (not shown) of the invention wherein both the core stranding direction and the armour winding direction are regularly reversed along the cable length so that the armoured cable comprises unilay sections alternating with unilay sections having opposite sign of the core stranding direction and the armour winding direction.

EXAMPLE 2

The permissible current ratings of the above mentioned cables were computed with various combinations of unilay and contralay sections.

The permissible current ratings were computed by using a numerical model of the cable and according to IEC 60287 for the following conditions: laying depth 0.8 m at top of the cable, ambient temperature of 15° C., soil thermal resistivity 0.7 K·m/W, and steady state conditions.

In particular, the permissible current rating has been computed according to the above mentioned formula (1) of IEC 60287 wherein, however, the armour losses and screen losses have been computed, taking into account, in said numerical model, that the cable comprises cores (in the example, three cores) helically stranded together with a core stranding pitch A and armour metal wires (in the example, 95 galvanized ferritic steel wires) helically wound around the cores with a armour winding pitch B.

The following Table 2 shows the computed values.

TABLE 2

| % contralay | % unilay | % (I-Ic)/Ic | % (L-Lc)/Lc |
|---|---|---|---|
| 100 | 0 | 0.00% | 0.00% |
| 90 | 10 | 0.44% | −4.53% |
| 80 | 20 | 0.88% | −9.01% |
| 70 | 30 | 1.32% | −13.45% |
| 60 | 40 | 1.87% | −17.86% |
| 50 | 50 | 2.31% | −22.22% |
| 40 | 60 | 2.75% | −26.55% |
| 30 | 70 | 3.19% | −30.84% |
| 20 | 80 | 3.63% | −35.09% |
| 10 | 90 | 4.07% | −39.30% |
| 0 | 100 | 4.51% | −43.47% |

Table 2 shows the permissible current ratings I and the cable losses L (in particular, armour and screen losses) computed in cables having increasing percentages of length in unilay configuration with respect to the permissible current rating Ic and the cable losses Lc, respectively, computed in a whole contralay cable (100% contralay configuration).

The computed values show that the permissible current rating I increases as the percentage of length in unilay configuration increases. On the other side, the cable losses (due to armour and metal screen losses) decrease in value as the percentage of length in unilay configuration increases.

As stated above, the rise of permissible current rating (and, accordingly, the reduction of cable losses) leads to two improvements in an AC transport system: increasing the current transported by a cable and/or providing a cable with a reduced cross section area X. This is very advantageous because it enables to make a cable more powerful and/or to reduce the size of the conductors with consequent reduction of cable size, weight and cost.

The armoured cable of the invention is thus built with a reduced value of the cross section area X of the electric conductor, as determined by the value of the reduced losses.

In alternative or in addition, the armoured cable of the invention is rated at the maximum allowable working conductor temperature θ to transport an alternate current I with an increased value, as determined by the value of the reduced losses. In particular, the armoured cable of the invention can be operated at the maximum allowable working conductor temperature θ so as to transport an alternate current I with an increased value, as determined by the value of the reduced losses.

The armoured cable of the invention can be operated with an increased value of the transported current and/or can be built with a reduced cross section area X, with respect to what calculated on the basis of the IEC 60287 recommendations.

In order to guarantee a good compromise between the two conflicting needs of increasing the permissible current rating I (and reducing the cable losses) and improving the mechanical stability of the cable, an armoured cable according to the invention preferably has 20-80% of unilay sections, more preferably 30-70%, even more preferably 40-60%, along the cable length. These values advantageously enable to obtain an increase in permissible current rating I, with respect to a whole contralay cable, of 0.88%-3.63%, 1.32%-3.19%, 1.87%-2.75%, respectively.

Moreover, in the armoured cable according to the invention, the preferred percentage of unilay sections is preferably attained by regularly arranging the unilay sections along the cable length L (regularly alternated with contralay sections) in order to avoid a cable configuration having a too long contralay section (e.g. covering a first half of the cable) followed by a too long unilay section (e.g. covering the second half of the cable). This latter solution would be disadvantageous both in mechanical terms (because the advantage of having alternating contralay and unilay sections is reduced) and electrical terms (because a potentially harmful voltage of a significant level can build up at the end of a long section that may be dangerous in submarine cables in case of water seepage).

Regarding total losses for capitalisation, in the cable of the invention they are computed as an average value of dissipated power per length unit (W/m) due to armour and screen losses in the contralay sections and unilay sections, weighted over the length covered by the contralay sections and the unilay sections. As the (armour and screen) losses in the unilay sections are lower than in the contralay sections, the total losses for capitalisation in the cable of the invention are reduced with respect to that of a whole contralay cable.

Moreover, the total losses for capitalisation in the cable of the invention are reduced with respect to what calculated on the basis of the IEC 60287 recommendations.

EXAMPLE 3

The permissible current ratings and the cable losses of the above mentioned cable as in the example 2 were computed with the difference that 48 (forty-eight) armour wires of galvanized ferritic steel were considered, instead of 95. The results are set forth in Table 3.

TABLE 3

| % contralay | % unilay | % (I-Ic)/Ic | % (L-Lc)/Lc |
|---|---|---|---|
| 100 | 0 | 0.00% | 0.00% |
| 90 | 10 | 0.21% | −3.83% |
| 80 | 20 | 0.43% | −7.65% |
| 70 | 30 | 0.64% | −11.46% |
| 60 | 40 | 0.85% | −15.26% |
| 50 | 50 | 1.07% | −19.06% |
| 40 | 60 | 1.28% | −22.84% |
| 30 | 70 | 1.49% | −26.61% |
| 20 | 80 | 1.71% | −30.38% |
| 10 | 90 | 1.92% | −34.13% |
| 0 | 100 | 2.13% | −37.88% |

Also in this example, the computed values show that the permissible current rating I increases as the percentage of length of unilay sections increases. On the other side, the cable losses L (armour and metal screen losses) decrease in value as the percentage of length of unilay sections increases.

The invention claimed is:

1. An armoured cable having a cable length and comprising:

a plurality of cores, each core comprising an electrical conductor surrounded by a respective insulating layer, stranded together according to a core stranding direction;

an armour surrounding the plurality of cores and comprising a layer of metal wires helically wound around the cores according to an armour winding direction;

wherein the plurality of cores are embedded in a polymeric filler and the armour surrounds the polymeric filler, and wherein at least one of the core stranding direction and the armour winding direction is recurrently reversed along the cable length L so that the armoured cable comprises unilay sections along the cable length where the core stranding direction and the armour winding direction are the same.

2. The armoured cable according to claim 1, wherein the at least one of core stranding direction and the armour winding direction is recurrently reversed along the cable length L so that unilay sections alternate along the cable length with contralay sections.

3. The armoured cable according to claim 1, wherein the unilay sections along the cable length L involve, as a whole, at least 40% of the cable length L.

4. The armoured cable according to claim 1, wherein a number N of consecutive turns of at least one of the core stranding and the armour winding in a first direction is the same or varies along the cable length L.

5. The armoured cable according to claim 4, wherein a number M of consecutive turns of at least one of the core stranding and the armour winding in a second direction, reversed with respect to the first direction, is the same or varies along the cable length L.

6. The armoured cable according to claim 5, wherein N is equal to or different from M.

7. The armoured cable according to claim 4, wherein $N \geq 1$.

8. The armoured cable according to claim 4, wherein $N \leq 10$.

9. The armoured cable according to claim 5, wherein $M \geq 1$.

10. The armoured cable according to claim 5, wherein $M \leq 10$.

11. The armoured cable according to claim 1, wherein the plurality of cores is stranded together according to a core stranding pitch A that, in modulus, is the same or varies along a cable length L.

12. The armoured cable according to claim 1, wherein the metal wires are wound around the plurality of cores according to an armour winding pitch B that, in modulus, is the same or varies along a cable length L.

13. The armoured cable according to claim 2, wherein the metal wires are wound around the plurality of cores according to an armour winding pitch B that, in the contralay sections, is greater, in modulus, than the armour winding pitch B in the unilay sections.

14. The armoured cable according to claim 1, wherein the core stranding direction is recurrently reversed along the cable length L and the armour winding direction is unchanged.

15. The armoured cable according to claim 1, wherein at least part of the armour metal wires are made of ferromagnetic material.

16. A method for improving the performances of an armoured cable having a cable length L and comprising a plurality of cores, each core comprising an electrical conductor surrounded by a respective insulating layer, stranded together according to a core stranding direction, each electric conductor having a cross section area X; and an armour surrounding the plurality of cores, the armour comprising a layer of metal wires helically wound around the cores according to an armour winding direction, the armoured cable having losses when an alternate current I is transported, said losses determining a maximum allowable working conductor temperature θ, the plurality of cores being embedded in a polymeric filler and the armour surrounds the polymeric filler, the method comprising the steps of:

reducing the losses by building the armoured cable such that the at least one of core stranding direction and the armour winding direction is recurrently reversed along the cable length L so that the armoured cable comprises unilay sections along the cable length L where the core stranding direction and the armour winding direction are the same;

building the armoured cable with a reduced value of the cross section area X of each electric conductor, as determined by the value of the reduced losses, and/or rating the armoured cable at the maximum allowable working conductor temperature θ to transport said alternate current I with an increased value, as determined by the value of the reduced losses.

17. A method for manufacturing an armoured cable with a cable length L having losses when an alternate current I is transported, said losses determining a rating of the cable at maximum allowable conductor temperature θ, comprising the steps of:

stranding a plurality of cores, each core comprising an electrical conductor surrounded by a respective insulating layer, together according to a core stranding direction, each electric conductor having a cross section area X;

embedding the plurality of cores in a polymeric filler and surrounding the plurality of cores by helically winding an armour comprising a layer of metal wires around the plurality of cores and the polymeric filler according to an armour winding direction;

wherein at least one of the core stranding direction and the armour winding direction is recurrently reversed along the cable length L so that the armoured cable comprises unilay sections along the cable length where the core stranding direction and the armour winding direction are the same; and wherein the cross section area X of each electric conductor is reduced and/or the rating of the cable at the maximum allowable working conductor temperature θ is increased, compared to a cable wherein the core stranding direction and armour winding direction are contralay along the cable length L.

* * * * *